United States Patent [19]

Stempfl

[11] Patent Number: 5,032,033

[45] Date of Patent: Jul. 16, 1991

[54] REDUCED BACKLASH MOUNTING FOR PRINTER CARRIAGES IN LINE PRINTERS

[75] Inventor: Gerhard Stempfl, Munich, Fed. Rep. of Germany

[73] Assignee: Siemens Aktiengesellschaft, Berlin and Munich, Fed. Rep. of Germany

[21] Appl. No.: 860,368

[22] Filed: May 6, 1986

[30] Foreign Application Priority Data

Jun. 7, 1985 [DE] Fed. Rep. of Germany ..... 3520569

[51] Int. Cl.[5] ..... B41J 19/00

[52] U.S. Cl. ..... 400/320; 400/328; 400/352

[58] Field of Search ..... 400/320, 322, 328, 352; 74/89.2, 89.21, 89.22; 360/106

[56] References Cited

U.S. PATENT DOCUMENTS

| | | | |
|---|---|---|---|
| 3,496,547 | 2/1970 | Gorrill et al. | 400/279 |
| 3,572,238 | 3/1971 | Andersen | 400/320 |
| 3,861,511 | 1/1975 | Nelson et al. | 400/320 |
| 3,957,148 | 5/1976 | Milliser et al. | 400/62 |
| 4,044,882 | 8/1977 | Weinke et al. | 400/320 |
| 4,293,235 | 10/1981 | Gomi | 400/352 |
| 4,303,347 | 12/1981 | Siegenthaler | 400/352 |
| 4,353,262 | 10/1982 | Talbot | 400/320 |
| 4,468,144 | 8/1984 | McMahon et al. | 400/320 |
| 4,572,685 | 2/1986 | Matsumoto et al. | 400/352 |

FOREIGN PATENT DOCUMENTS

| | | | |
|---|---|---|---|
| 2132560 | 7/1984 | United Kingdom | 360/106 |

*Primary Examiner*—Clifford D. Crowder
*Attorney, Agent, or Firm*—Mark H. Jay

[57] ABSTRACT

A printer carriage is carried by the guide bars of a printing unit with the help of busings and is moved along the guide bars by means of a traction mechanism. The traction mechanism is attached to the printer carriage and/or the bearing elements, in such a way that a compensating torque is exerted on the printer carriage or the bearing elements. The compensating torque counterbalances the torque generated during reversal of movement so that the carriage does not rock when it reaches an endpoint of its travel.

4 Claims, 2 Drawing Sheets

REDUCED BACKLASH MOUNTING FOR PRINTER CARRIAGES IN LINE PRINTERS

BACKGROUND OF THE INVENTION

The invention relates to an arrangement for mounting and moving printers carriages in printing units.

In hard-copy printers, such as those being used for personal computers or text-printing devices, a dot-matrix print head is generally moved along a platen by means of a motor. The print head is attached to a printer carriage which in turn is supported by means of bushings on guide bars. The motor-driven line or toothed belt which serves as a traction mechanism is generally attached to a projection on the printer carriage or bushing.

During printing with printing units of this type, the printer carriage moves back and forth between two return points, and the bearings clearance in the bushings rocks the printer carriage at the return points during the carriage's change in direction. This rocking motion of the printer carriage produces additional noise as well as type misalignment.

This noise and misalignment is only acceptable in rudimentary printers.

There has been an attempt to compensate for these characteristics in high-quality printing units by hardening the bushings. However, this causes increased friction and greater wear. The use of high-precision backlash-free circulating ball sleeves to solve the problem involves considerable design and production costs.

One object of the invention is to develop a device for driving the aforesaid type of printer carriages such that the bearing clearance in the bearing elements of the printer carriage does not produce noise and type misalignment.

SUMMARY OF THE INVENTION

In accordance with the invention, the traction mechanism, e.g. a line or a toothed belt, is attached to the printer carriage and/or the bearing elements at two spaced-apart points, and the points of attachment of said traction mechanism are so arranged, parallel to the direction of movement, that a torque is exerted on said printer carriage or said bearing elements. This torque is used to exactly counterbalance the rocking which is produced by the bearing clearance in said bearing elements during the reversal of movement.

When attaching the traction mechanism near the horizontal axis passing through the center-of-gravity, only a very small torque is required for the carriage to slide on definite contact surfaces located on the running axis, without generating additional friction. When the traction mechanism is attached outside this horizontal axis, it is possible to compensate for the tipping torque of the carriage during the reversal phase by introducing a correspondingly dimensioned torque. At the same time, the torque can be dimensioned by the displacement, i.e. the distance of the two fastening points and by the belt tensioning.

In contrast to conventional simple daisy-wheel or matrix printers, the device according to the invention makes it possible, without incurring additional costs, to prevent the noise caused by the tipping of the printer carriage during the reversal phase, as well as the resulting type misalignment.

BRIEF DESCRIPTION OF THE DRAWINGS

Exemplary and non-limiting preferred embodiments of the invention are shown in the drawings, in which.

DETAILED DESCRIPTION OF PREFERRED EMBODIMENTS

In the following, the elements shown in FIG. 1 through 5 have the same designations.

Figure 1:
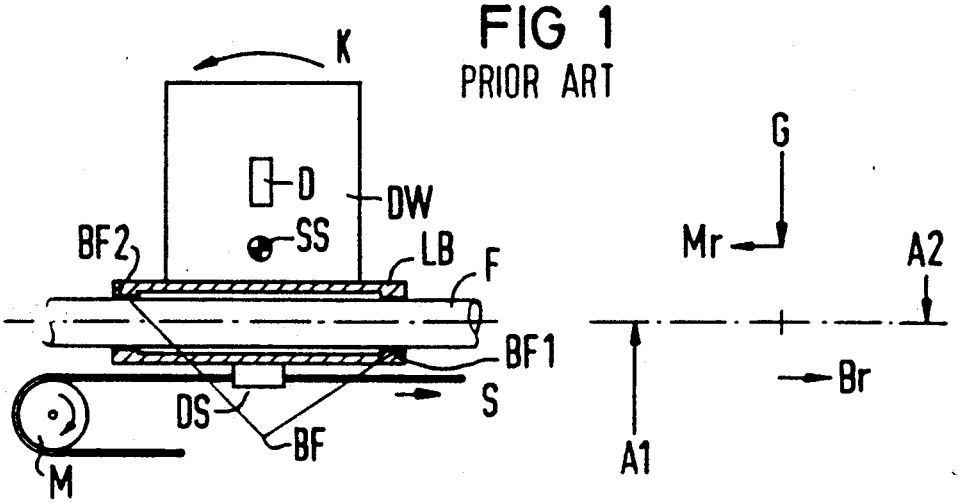
FIG 1 PRIOR ART
FIGS. 1 and 2 show a conventional printer carriage mounting and the forces acting on it at the left and right return points respectively.
Figure 2:
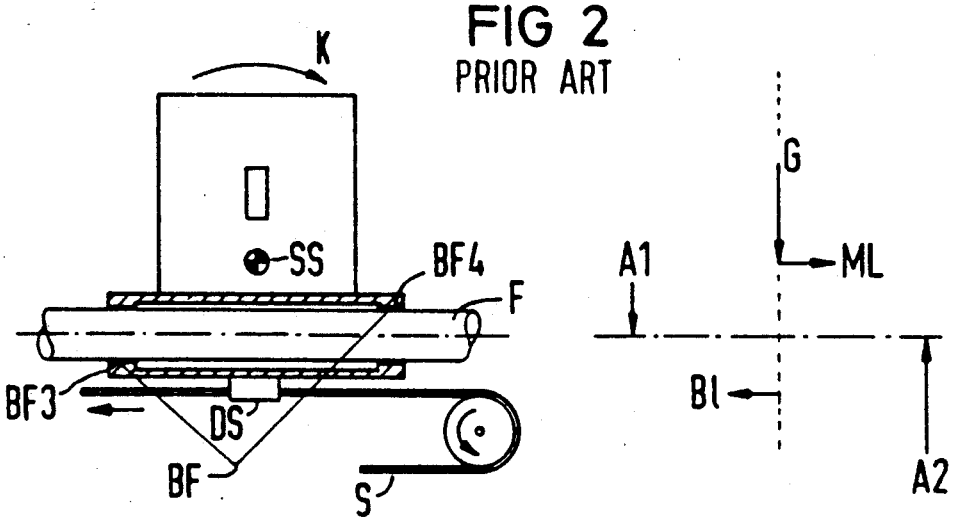
FIG 2 PRIOR ART

In a dot-matrix printer, shown here schematically, a print head D arranged on a printer carriage DW is moved line by line by means of a motor M along a platen (not shown). The printer carriage DW is carried by guide bars F of the printer by means of a bushing LB which is so shaped that the ends of said bushing LB are supported by the guide bar F via the contact surface BF. Further, the motor M is connected with the printer carriage DW of the bushing LB via a toothed belt S. Normally, as is shown in FIG. 1 and 2, the belt S is attached at one point, i.e., at the fastening point DS of the bushing LB. If, by means of the belt S, the printer carriage DW is then moved by a conventional mechanism to the right in the direction of the arrow, as is indicated in FIG. 1, said printer carriage DW will only be supported at points BF1 and BF2 as a result of the bearing clearance in the bushing LB. Consequently, during the reversal of movement, a tipping motion K of the printer carriage DW occurs in the direction of the arrow. During the reversal of movement at the left return point, the forces indicated on the right-hand side will be generated. In this respect, the length of the arrows corresponds to the magnitude of the individual forces. The following common designations apply to the individual arrows:

G: weight;
Mr. inertia, clockwise rotation;
ML: inertia, counterclockwise rotation;
Br: acceleration, clockwise rotation;
BL: acceleration, counterclockwise rotation;
Rs: belt tensioning;
A1: support, left;
A2: support, right; and
SS: system center of gravity.

In accordance with the forces (torques) generated illustrated in FIG. 2, a tipping motion K in the opposite direction of the tipping motion of FIG. 1 results from the bearing clearance at the right return point, when the printer carriage is moved toward the left (direction of the arrow). At the same time the bushing LB is only supported with the surfaces BF3 and BF4 on the guide bar F.

Figure 3:
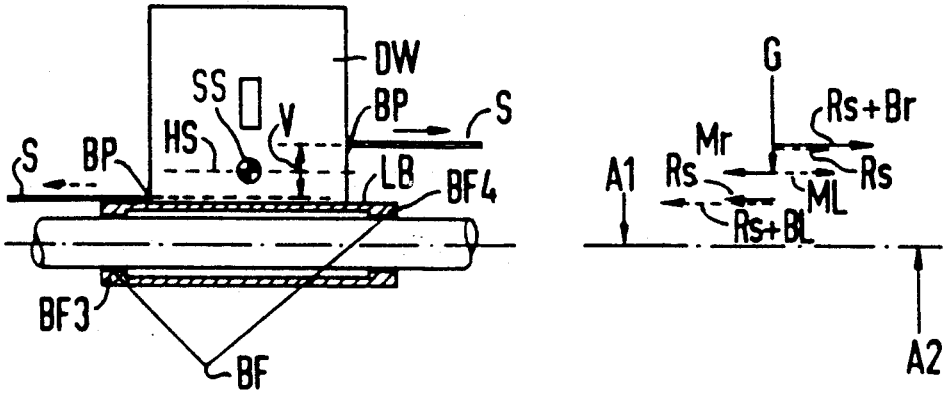
FIG. 3 shows a first preferred embodiment of the invention and the forces acting upon it.

In accordance with the embodiment of FIG. 3, the traction mechanism S is attached at two points to the printer carriage. The points of attachment are arranged symmetrically above and below the axis HS, which passes through the center of gravity SS. The points of attachment BP are also symmetrically arranged on either side of the center of gravity SS. This generates the forces indicated in the righthand section of FIG. 3 and thus a directed torque— provided, however, that the vertical offset V is properly chosen. During a change in the direction of movement in the areas of reversal, said generation of torque prevents the tipping motion of the printer carriage DW. At the same time the bushing LB is free from backlash, and its surfaces BF3 and BF4 are located on top of the guide bar F.

Figure 4:
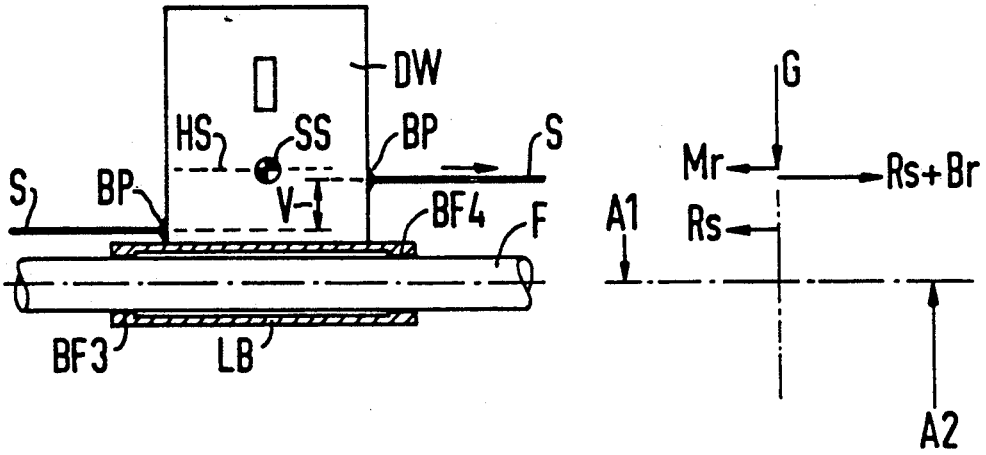
FIGS. 4 and 5 show a second preferred embodiment of the invention and the forces acting upon it during rightward and leftward motion respectively.
Figure 5:
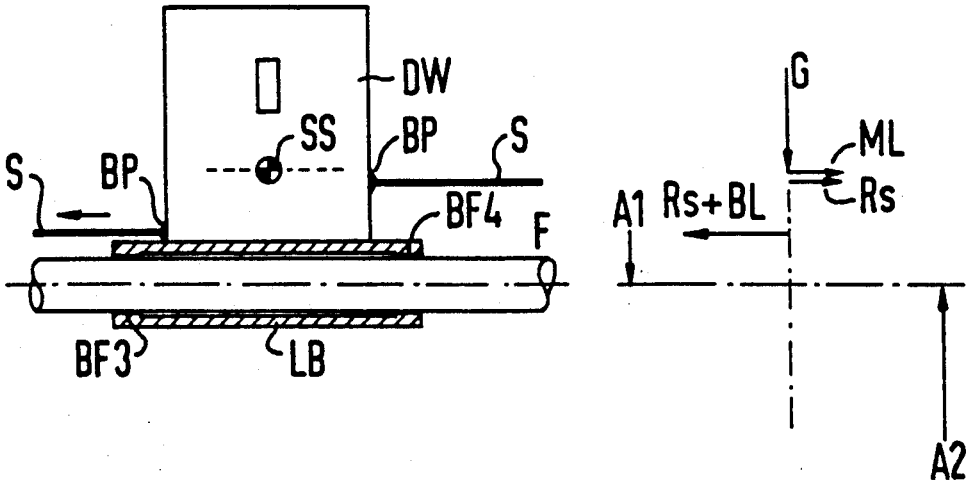

When attaching the belt S so that both points of attachment BP are on the same side of the center of gravity SS, as is illustrated in FIGS. 4 and 5, it is possible to compensate for the tipping motion of the printer carriage DW during reversal of direction by introducing a correspondingly dimensioned torque, i.e., by correspondingly dimensioning the vertical offset V or by correspondingly dimensioning the belt tensioning Rs. A corresponding distribution of forces will result in a balanced generation of torque, as is illustrated in FIGS. 4 and 5.

Those skilled in the art will understand that changes can be made in the preferred embodiments here described, and that these embodiments can be used for other purposes. Such changes and uses are within the scope of the invention, which is limited only by the claims which follow.

What is claimed is:

1. A drive mechanism for use with printer carriage assemblies of the type which are carried along a guide, comprising:

means for moving the assembly back and forth along said guide, said moving means being secured to said assembly at two points which are spaced apart from each other in a direction which is perpendicular to the directions of motion of the assembly, whereby said moving means exerts a unidirectional torque upon the assembly and compensates for oppositely-directed acceleration of the assembly upon reversal of its direction of motion.

2. The drive mechanism of claim 1, wherein a one of said points is above the center of gravity of the assembly and another one of said points is below said center of gravity.

3. The drive mechanism of claim 1, wherein said points are both above or both below the center of gravity of the assembly.

4. The drive mechanism of claim 1, wherein said carriage assembly is mounted to said guide using a bushing.

* * * * *